US005344157A

United States Patent [19]

McCord

[11] Patent Number: 5,344,157

[45] Date of Patent: Sep. 6, 1994

[54] PORTABLE VOLLEYBALL NET ASSEMBLY

[76] Inventor: Mahan K. McCord, 301 Live Oak, Atlanta, Tex. 75551

[21] Appl. No.: 121,150

[22] Filed: Sep. 13, 1993

[51] Int. Cl.[5] ..... A63B 61/00

[52] U.S. Cl. ..... 273/411; 273/29 B

[58] Field of Search ..... 273/411, 29 B

[56] References Cited

U.S. PATENT DOCUMENTS

| | | | |
|---|---|---|---|
| 3,953,029 | 4/1976 | Boyd | 273/411 X |
| 4,415,163 | 11/1983 | Schoenig | 273/411 |
| 4,720,112 | 1/1988 | Stettner | 273/411 |
| 4,732,395 | 3/1988 | Halverson | 273/411 |
| 4,830,382 | 5/1989 | Wheeler | 273/411 |
| 4,913,428 | 4/1990 | Nauman | 273/29 |
| 4,948,149 | 8/1990 | Lin et al. | 273/411 |
| 4,968,043 | 11/1990 | Allbright | 273/411 |
| 5,058,899 | 10/1991 | Jackson et al. | 273/411 |
| 5,106,101 | 4/1992 | McKay | 273/411 |
| 5,156,408 | 10/1992 | Hall | 273/411 |
| 5,215,310 | 6/1993 | Allbright | 273/411 |

FOREIGN PATENT DOCUMENTS

| | | | |
|---|---|---|---|
| 1015722 | 10/1952 | France | 273/411 |

OTHER PUBLICATIONS

Centerline Sports "Weekender" catalog, Kill Court volleyball net advertisement/Aug., 1993 edition of Volleyball Monthly magazine, Spectrum volleyball net system.

*Primary Examiner*—William H. Grieb

*Attorney, Agent, or Firm*—John M. Harrison

[57] ABSTRACT

A portable volleyball net assembly characterized by a vertically-adjustable net which is continuously supported along the edges by net cylinders or rods engaging a pair of net support poles stabilized vertically by tensioning cords. In a first embodiment the assembly includes an elongated, rectangular net, each vertical edge of which is secured along the entire length by means of a binder or sleeve to a tubular net cylinder which slidably receives a net support pole assembled from three tubular support members attached by connecting joints. The net cylinders and net are vertically supported by friction or by adjusting pins which are extended through pin openings provided in each net support pole. A tensioning cord vertically stabilizes each net support pole and is fastened at one end to a stake in the ground, while the other end loops through a clevis mounted on the top of the net support pole. In a second embodiment each net cylinder is secured to a pair of spaced support rings or cylinders which slidably receive the upper end of a corresponding net support pole. The net can be vertically adjustably supported either by friction or by using the adjusting pins as in the previous embodiment or by using a loop-pile stay which wraps around the net support pole and each corresponding net cylinder.

13 Claims, 2 Drawing Sheets

FIG. 1
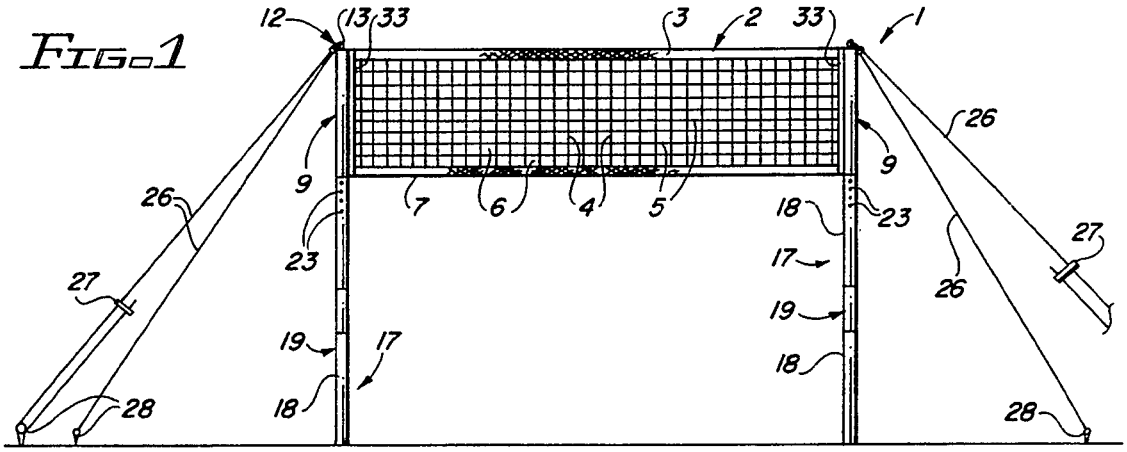
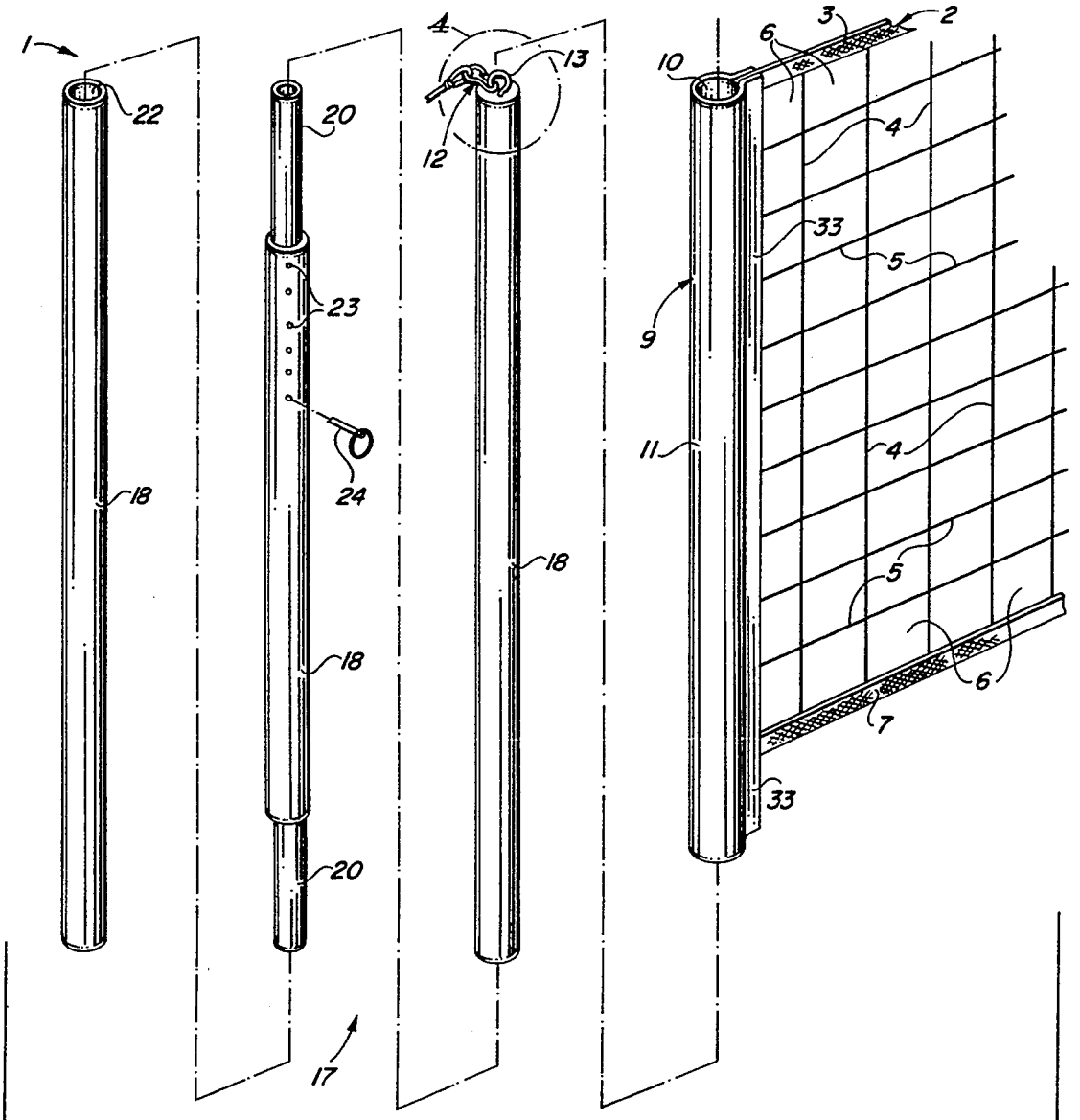
FIG. 2

PORTABLE VOLLEYBALL NET ASSEMBLY

BACKGROUND OF THE INVENTION

1. Field of the Invention

This invention relates to volleyball nets and more particularly, to a portable volleyball net assembly characterized by a vertically-adjustable net supported continuously along the edges by a binder attached to each one of a pair of net cylinders or rods engaging a pair of parallel net support poles which are preferably assembled from three tubular support members. The net is tensioned in playing position using a pair of tensioning cords, each of which has a first end attached to a stake penetrating the ground and loops through a cord ring or clevis mounted on each corresponding net support pole, descending outwardly and looping through a second stake in the ground. The second end then attaches to a cord stay which is slidably mounted on the descending tensioning cord, to allow variations in net tension. In a first embodiment the net is connected along the edges to a pair of parallel, tubular net cylinders by means of a binder or sleeve, each of which net cylinders slidably receives the upper end of a net support pole and is secured in position by friction due to the tension exerted by the tensioning cords. Alternatively, multiple, vertically-spaced pairs of diametrically-opposed pin openings are provided in the middle support member of each net support pole, each pair of pin openings adapted for receiving an adjusting pin which supports the corresponding net cylinder at a selected height. In a second embodiment a pair of spaced support rings is fixed laterally to each net cylinder and slidably receives a net support pole. Vertically-adjustable support of the net is facilitated either by tension applied by the tensioning cords or using the adjusting pins as in the previous embodiment, or by using a loop-pile stay strap which wraps around the top support member of the net support pole and the corresponding net cylinder. In a third embodiment, the two support rings are replaced by a support cylinder which slidably receives each net support pole and is adjustably supported by tension or by using the adjusting pin or loop-pile stay, as described above.

2. Description of the Prior Art

Various apparatuses for supporting a volleyball net are known in the art. U.S. Pat. No. 4,415,163 dated Nov. 15, 1983, to Darrell A. Schoenig, discloses a "Portable Volleyball Apparatus" characterized by a pair of spaced poles, each telescopically adjustable in height and including lockable clamps to fix the desired height of a net which spans the two poles and is attached thereto by means of ties. A pair of cords diverges downwardly and outwardly from the top of each corresponding pole to attach with stakes in the ground. U.S. Pat. No. 4,732,395, dated Mar. 22, 1988, to James E. Halverson, details a "Free-Standing Sport Net Stand" including a supporting foot member, upon which a riser and extension member are cooperatively connected in a generally upward direction. A leg and weight assembly are outwardly connected to the foot member, generally perpendicular to the riser and extension member. U.S. Pat. No. 4,830,382, dated May 16, 1989, to Wesley T. Wheeler, describes a "Portable Volleyball Net Support System", including a pair of telescoping poles having a net support line attached thereto at one end, with the opposite end of the net support line extending downwardly along the opposite telescoping pole to engage a one-way cleat having a pair of jam plates positioned to define an outwardly-flaring, line-receiving channel. The jam plates are contoured to define multiple, spaced ridges extending from the bottom of the channel diagonally outwardly and toward the end of the channel opposite from the end at which the support line enters the channel from the net. The ridges permit the support line to be pulled through the channel with minimal resistance and then forced downwardly into the channel when the tensioning pull on the support line is released, which, in turn, causes the support line to be tightly gripped by the ridges. U.S. Pat. No. 4,913,428, dated Apr. 3, 1990, to Earl J. Nauman, discloses a "Portable Net-Tightening Post Assembly" for supporting sports nets, tarpaulins, awnings and the like, including a post anchor with downwardly-extending prongs which are formed of flat spring metal and are adapted to be embedded in a penetrable support surface such as sand or soil. The prongs are fastened to the bottom surface of a base plate of the post anchor at locations displaced outwardly from a post or pole which extends upwardly from the top surface of the base plate. The resiliency of the prongs maintains the tautness of a net, tarpaulin, awning or the like which spans a pair of the post assemblies. U.S. Pat. No. 4,948,149, dated Aug. 14, 1990, to Joe Lin, et al, describes "Net Posts For Ball Games" characterized by multiple hollow tubes which have different diameters and can be fitted over one another. An adaptor, including an outer screwed sleeve member and a lining press member, is provided for the connection of two of the tubes. A slidable threading lug is fitted over each of the hollow tubes. The net posts can be reduced in dimensions to facilitate storage, shipment and carrying by fitting one hollow tube over another. U.S. Pat. No. 4,968,043 dated Nov. 6, 1990, to E. T. Allbright details a recreational net formed with multiple loops along the edges for engaging the net support poles. U.S. Pat. No. 5,106,101, dated Apr. 21, 1992, to David C. McKay, details a "Games-Net Support" having a flat ground plate with a central threaded aperture. A threaded rod is screwed into the aperture and extends from the bottom surface of the plate to a variable length, as desired. A hollow tube is perpendicularly positioned on and attached to the top surface of the plate, extending up to support a net. Two spaced supports are used for the net. U.S. Pat. No. 5,156,408, dated Oct. 20, 1992, to John F. Hall, describes a "Net Support" for supporting tennis nets, badminton nets, volleyball nets and the like. A cross member is pivoted to the lower end of a post and is adjustable to account for an inclined surface. A support leg is swingably attached to the post and is of adjustable length so that the post can be adjusted perpendicular to a horizontal surface. An additional volleyball net apparatus in use is the "Kill Court" (trademark) owned by Centerline Sports of Estes Park, Colo., licensed by Sideout Sport and illustrated and described in the "Sideout Weekender" brochure, which apparatus is characterized by a net fastened at each end to a net cylinder which is slidably received by a pair of spaced rings mounted on the upper end of a net support pole. Another apparatus is detailed in the August, 1993, issue of Volleyball Monthly, entitled Park & Sun U.S.A. Featured is a volleyball net having a flexible sleeve fitted over a pair of supports and secured to the supports by means of a cable.

One of the problems encountered in erecting a volleyball net is variations in the elevation of the playing area where a volleyball net is to be erected. This frequently results in a slanted net which is higher at one end than at the other, because one net support pole stands upon a higher elevated section of ground than the opposite net support pole. Additionally, the standard net heights for volleyball differ for men and women; the standard net height for men is eight feet, whereas the standard net height for women is seven feet, four and one-fourth inches. Many conventional volleyball net assemblies do not include a net which may be adjusted in height, creating a problem when men and women, as well as children, must use the same volleyball net, as in tournaments. Another problem lies in net stretch and sag, as well as the complexity and inefficiency of attaching the net to the support poles. Ties at the top and bottom of the net are commonly used for this purpose, but are difficult to tighten sufficiently to prevent net sag. Even when removable sleeves, loops or alternative devices are used to correct this problem, the ties or cables combined with these devices stretch and also add to the complexity of such assemblies.

Accordingly, it is an object of this invention to provide a portable volleyball net assembly including a net which minimizes net sag and stretch and is secured continuously along its two edges by means of a fixed binder or sleeve to two parallel, independently vertically-adjustable net cylinders which slidably receive the top segment of corresponding net support poles, vertically stabilized by tensioning cords.

It is another object of this invention to provide a portable volleyball net assembly having a volleyball net with minimum stretch and sag, each vertical edge of which is continuously fixedly secured by means of a binder to a tubular or solid net cylinder suitably adapted for slidably receiving the upper portion of a net support pole assembled from three tubular or solid support members which are joined by connecting joints, the middle of which support members may be provided with multiple, vertically-spaced pairs of diametrically-opposed pin openings, each sized for receiving an adjusting pin for supporting the corresponding net cylinder at a selected height, independently of the height of the opposite net cylinder, and the top of each of which net support poles is vertically stabilized by a tensioning cord which is secured by stakes penetrating the ground.

A further object of the invention is to provide a portable volleyball net assembly characterized by a net having minimum stretch and sag and secured vertically and continuously along the edges in fixed relationship to a binder or sleeve, and the binder fixed to a pair of parallel net cylinders or solid tubular members, each, in turn, fitted with a pair of spaced support rings for slidably receiving the top portion of a net support pole which is stabilized in vertical playing position by a tensioning cord secured by stakes and is assembled from three tubular support members joined by connecting joints. The vertically-adjustable support of each pair of support rings is facilitated either by friction or by sliding an adjusting pin through one of multiple, vertically-spaced pairs of diametrically-opposed pin openings provided in the middle support member and supporting the corresponding support ring on the protruding ends of the adjusting pin, or by using a loop-pile stay which wraps around the net support pole and corresponding net cylinder.

A still further object of the invention is to provide a simple, yet efficient portable volleyball net assembly including a net having minimum sag spanning and connected permanently and continuously along parallel edges to a pair of spaced, vertical, parallel net cylinders by means of a binding material, each of which net cylinders longitudinally fixedly secures a lateral tubular or solid support member suitably adapted for slidably receiving the top portion of a net support pole which is assembled from three tubular or solid support members joined by connecting joints, and is vertically stabilized by a tensioning cord which loops through a cord ring or clevis on the net support pole and is secured by stakes, the vertically-adjustable support of each support cylinder being facilitated either by friction or by resting the support cylinder on the protruding ends of an adjusting pin extending through one of multiple, vertically-spaced pairs of diametrically-opposed pin openings provided in the middle support member, or by using a loop-pile stay which wraps around the net support pole and corresponding support cylinder.

SUMMARY OF THE INVENTION

These and other objects of the invention are provided in a portable volleyball net assembly characterized by a net of uniform height spanning a pair of vertical, parallel, tubular net cylinders and permanently connected to the net cylinders continuously along opposite edges by a binding material such as tape, fabric, fiberglass, glue or the like, each of which net cylinders, in one embodiment, is suitably adapted for receiving the upper portion of a net support pole assembled from three tubular support members joined at connecting joints, and each net cylinder being vertically and independently adjustably supported by friction due to tension applied to the net support poles or by resting on the protruding ends of an adjusting pin extending through one of multiple, vertically-spaced pairs of diametrically-opposed pin openings provided in the middle support member. In a second embodiment the net cylinders or bars are each fixed to a pair of spaced support rings adapted for slidably receiving the top portion of a net support pole, also assembled from three tubular support members joined at connecting joints, each pair of support rings and corresponding net cylinder being vertically independently adjustably supported by friction due to tension applied to the net support poles or by allowing the lower support ring to rest on the protruding ends of an adjusting pin extending through one of several vertically-spaced pairs of diametrically-opposed pin openings provided in the middle support member, or, alternatively, the net cylinders being vertically independently adjustably supported by means of a loop-pile stay which wraps around the net support pole and corresponding net cylinder. In still another embodiment the net cylinders are each fixed to a lateral, longitudinally-attached tubular support cylinder adapted for slidably receiving the top portion of a net support pole assembled from the three support members as described above, which support cylinder is vertically adjustably supported by means of the mechanisms described in the previous embodiment and which net support poles in all embodiments are each vertically stabilized by means of a tensioning cord which is fastened to a pivotally mounted ring or clevis secured to the top of each net support pole and is anchored by stakes penetrating the ground.

BRIEF DESCRIPTION OF THE DRAWINGS

The invention will be better understood by reference to the accompanying drawings, wherein:

FIG. 1 is a front view of a first preferred embodiment of the portable volleyball net assembly of this invention;

FIG. 2 is an exploded view of the portable volleyball net assembly illustrated in FIG. 1;

DESCRIPTION OF THE PREFERRED EMBODIMENTS

Figure 3:
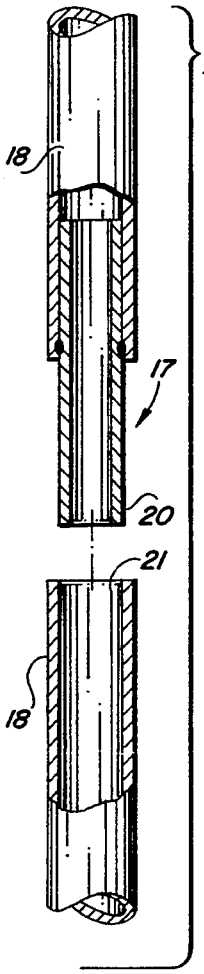
FIG. 3 is a sectional view of a preferred embodiment of the net support poles of the portable volleyball net assembly of this invention.
Figure 4:
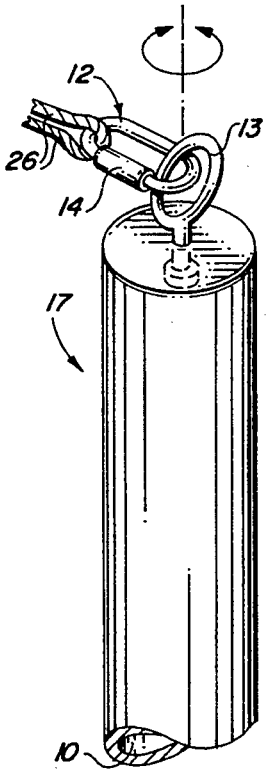
FIG. 4 is a perspective view of a preferred clevis and clevis eye tensioning cord mount in the portable volleyball net assembly.

Referring initially to FIGS. 1–4 of the drawings, the portable volleyball net assembly of this invention is generally illustrated by reference numeral 1. The portable volleyball net assembly 1 includes an elongated, rectangular net 2, characterized by a top net margin 3 and a bottom net margin 7, which are spanned by multiple, equally-spaced vertical strands 4. Multiple, equally-spaced horizontal strands 5 are arranged perpendicular to the vertical strands 4, defining multiple mesh openings 6. The top net margin 3 and bottom net margin 7, in addition to each horizontal strand 5, are permanently attached at each end along the entire length of the edges thereof, to a sleeve or binder 33, also fixedly secured to a corresponding separate, vertical tubular net cylinder 9, each characterized by a continuous net cylinder wall 11 which defines a net cylinder bore 10, as illustrated in FIG. 2. The portable volleyball net assembly 1 is provided with two net support poles 17, each of which is preferably assembled from three tubular support members 18, the middle one of which is characterized by a pair of tapered joint pins 20, adapted for removably fitting into the corresponding hollow joint sockets 21, provided in the upper end of the lower support member 18 and the lower end of the upper support member 18, to define connecting joints 19. Accordingly, as illustrated in FIGS. 1–3 of the drawings, in a first preferred embodiment of the invention each net cylinder 9 fits over and slidably receives the uppermost support member 18 of a net support pole 17. Multiple, vertically-spaced pairs of diametrically-opposed pin openings 23 are included in each middle support member 18, as illustrated in FIGS. 1 and 2. Each net cylinder 9 is vertically adjustably supported by resting the lower circumferential edge of the net cylinder 9 on the two protruding ends of a short, straight rod or adjusting pin 24 which is slidably extended through a selected pair of pin openings 23, corresponding to the desired height of the net 2, as illustrated in FIG. 1.

Figure 5:
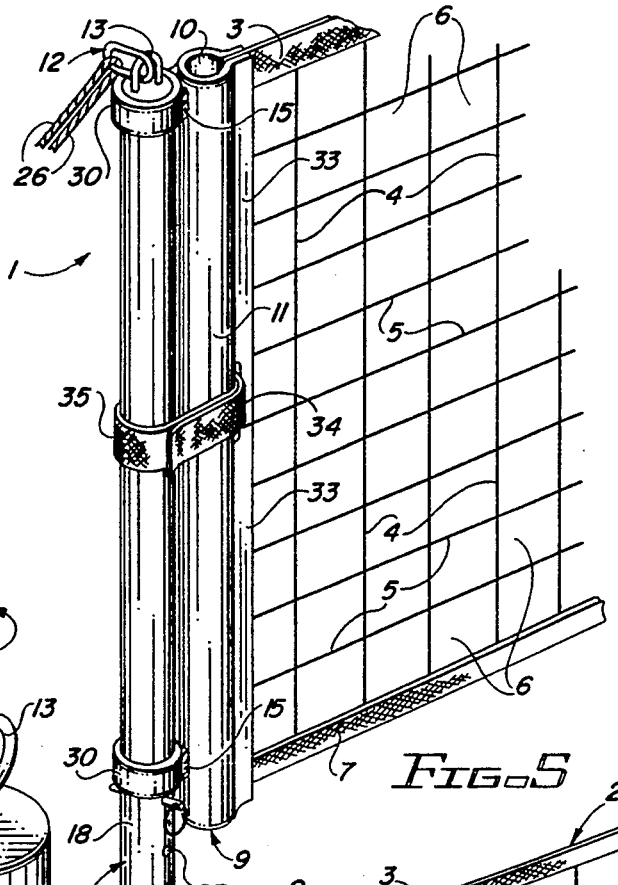
FIG. 5 is a perspective view, partially in section, of a net support pole engaging parallel support rings and a preferred tensioning cord mount of a second preferred embodiment of the portable volleyball net assembly of this invention.

Referring next to FIG. 5 of the drawings, in a second preferred embodiment each net cylinder 9 may be solid, as in a bar, and is fixedly secured to a pair of lateral support rings 30, spaced roughly according to the vertical dimension of the net 2 and secured by welds or glue 15, or bolted or otherwise fixed to the net cylinders 9. Each pair of support rings 30 receives the uppermost support member 18 of a net support pole 17. Each of the net cylinders 9 is vertically adjustably supported, independently of the other, either by allowing the lower support ring 30 to rest upon the protruding ends of an adjusting pin 24 which is slidably extended through a selected pair of diametrically-opposed pin openings 23, or by using a loop-pile stay 35, which wraps around each net cylinder 9, extends through a binder slot 34 in the binder 33 and wraps around a corresponding net support pole 17 to support the net 2, as illustrated.

Figure 6:
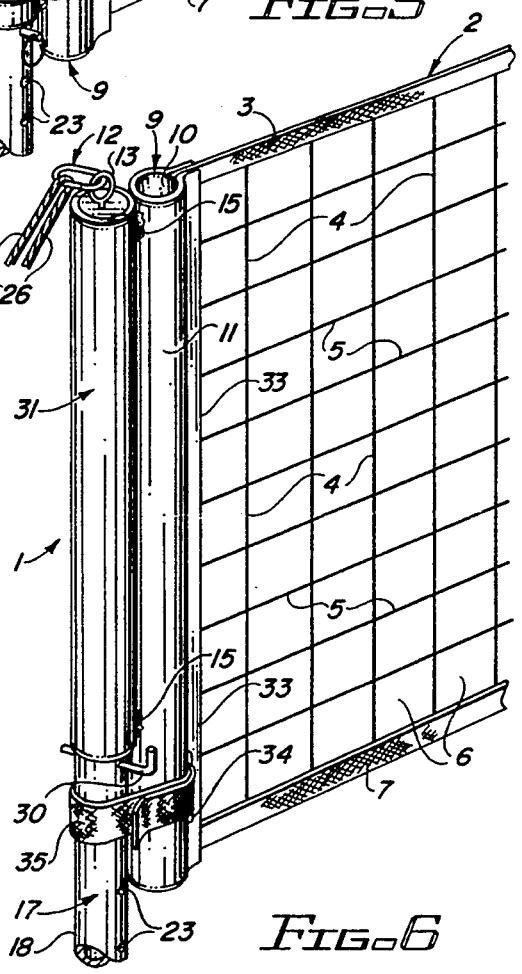
FIG. 6 is a perspective view, partially in section, of a net support pole engaging a support cylinder of a third preferred embodiment of the portable volleyball net assembly of this invention.

Referring now to FIG. 6 of the drawings, in a third preferred embodiment of the invention each net cylinder 9 is provided with a lateral, longitudinally-attached support cylinder 31 which is secured by means of welds or glue 15 or otherwise attached to the net cylinders 9 and is further characterized by a continuous bore (not illustrated). Each support cylinder 31 fits over and slidably receives the uppermost support member 18 of a net support pole 17. Each net cylinder 9 and corresponding support cylinder 31 are vertically adjustably supported, either by allowing the support cylinder 31 to rest upon the protruding ends of a corresponding adjusting pin 24 extending through a selected pair of diametrically-opposed pin openings 23 provided in the middle support member 18, or by wrapping a loop-pile stay 35 around a net cylinder 9, through the binder slot 34 in the binder 33 and around the corresponding support cylinder 31 at the desired height of the net, as described above.

Figure 7:
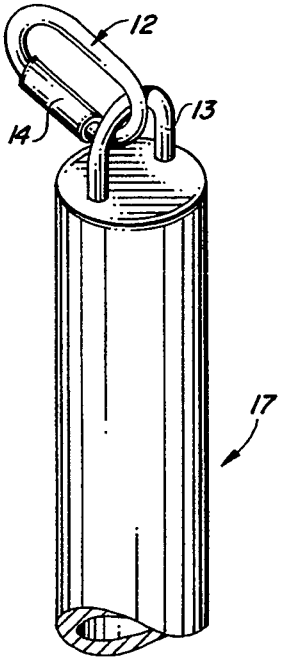
FIG. 7 is a perspective view, partially in section, of an alternative clevis eye design for mounting the clevis on the support pole.

Referring again to FIGS. 1–6 and to FIG. 7 of the drawings, each net support pole 17 of the portable volleyball net assembly 1 is vertically stabilized by a tensioning cord 26. In a most preferred embodiment a clevis eye 13 is threaded or bolted (FIG. 4) or encapsulated (FIG. 7) into the upper end of the uppermost support member 18 of each net support pole 17. A cylinder clevis 12, with an opening (not illustrated) which is closed by a spring-loaded clevis stay 14, is swivelly or pivotally attached to the protruding portion of the clevis eye 13. A tensioning cord 26 has a first end attached to a stake 28 which penetrates the ground and anchors one end of the tensioning cord 26 and a second end of the tensioning cord 26 loops through the cylinder clevis 12 and then descends outwardly to engage a second stake 28, also penetrating the ground as an anchor. The second end of the tensioning cord 26 then attaches to a cord stay 27, which slidably engages the descending portion of the tensioning cord 26, to allow variations in the tension of the tensioning cord 26.

It will be appreciated that the portable volleyball net assembly of this invention avoids the net stretch and sag, complexity and inefficiency of the prior art by providing net deployment systems in which the entire length of the edges of the net are permanently secured to net cylinders or rods by means of stabilizing binders, without the necessity of using individual ties, tensioning lines or cables. Tensioning of the net is accomplished using the tensioning cords and clevis combination without the disadvantage of stretching net cords or cables used in conventional systems to mount the net on the net support poles. Referring again to the drawings, the binder 33 can be attached directly to the net support poles 17 by any suitable means, including gluing, taping, using fiberglass cloth and epoxy resins, or applying various fabrics and stitching the fabric in place, in non-exclusive particular.

Accordingly, while the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A portable volleyball net assembly for erection on a playing surface, comprising a volleyball net having opposite edges; elongated, cylindrical net mounts fixedly attached to said edges of said volleyball net; at least one support means fixedly carried by said net mounts; support legs engaging the playing surface and slidably receiving said support means in vertically adjustable relationship for vertically adjusting the height of said volleyball net above the playing surface; at least one loop-pile fastener engaging said support legs and said net mounts for adjustably securing said net mounts and said net at a selected height on said support legs above the playing surface; and tensioning cords connected to the tops of said support legs and anchored to the playing surface for applying tension to said volleyball net and securing said net mounts and said support means in a selected position on said support legs.

2. The portable volleyball net assembly of claim 1 comprising clevis means attached to the tops of said support legs for receiving and anchoring said tensioning cords on said tops of said support legs 3.

3. The portable volleyball net assembly of claim 1 comprising pin openings provided in spaced relationship with respect to each other in said support legs beneath said net mounts and pin means for selective insertion in said pin openings and adjusting the height of said net mounts and said volleyball net on said support legs above the playing surface.

4. The portable volleyball net of claim 3 wherein said support means comprises a support tube.

5. The portable volleyball net of claim 4 comprising clevis means attached to the tops of said support legs for receiving and anchoring said tensioning cords on said tops of said support legs.

6. The portable volleyball net of claim 3 wherein said support means comprises at least a top ring and a bottom ring fixedly carried by each of said net mounts in spaced relationship with respect to each other and said pin openings are disposed in said support legs beneath said bottom ring.

7. The portable volleyball net of claim 6 comprising clevis means attached to the tops of said support legs for receiving and anchoring said tensioning cords on each of said support legs.

8. The portable volleyball net of claim 1 comprising:

(a) clevis means attached to the tops of said support legs for receiving and anchoring said tensioning cords on said tops of said support legs; and (b) pin openings provided in spaced relationship with respect to each other in said support legs beneath said net mounts and pin means for selective insertion in said pin openings for adjusting the height of said net mounts and said volleyball net on said support legs above the playing surface.

9. The portable volleyball net of claim 1 wherein said support means comprises a support tube.

10. The portable volleyball net of claim 9 comprising clevis means attached to the tops of said support legs for receiving and anchoring said tensioning cords on said tops of said support legs.

11. The portable volleyball net of claim 1 wherein said support means comprises at least two rings fixedly carried by each of said net mounts in spaced relationship with respect to each other.

12. The portable volleyball net of claim 11 comprising clevis means attached to the tops of said support legs for receiving and anchoring said tensioning cords on said tops of said support legs.

13. A portable volleyball net assembly for erection on a playing surface, comprising a volleyball net having edge margins at each end; an elongated, cylindrical net mount extending at least along the entire length of each of said edge margins and attached to said edge margins in fixed relationship; cylindrical supports fixedly carried by said net mounts; support legs having one end contacting the playing surface and the opposite end of said support legs slidably receiving said cylindrical supports in vertically-adjustable relationship; loop-pile retaining means engaging said support legs and said net mount for vertically adjusting the height of said volleyball net above the playing surface; clevis means pivotally attached to the opposite ends of said support legs; and tensioning cords connected to said clevis means and anchored to the playing surface for applying tension to said volleyball net.

* * * * *